US011478074B1

(12) United States Patent
Burrows et al.

(10) Patent No.: US 11,478,074 B1
(45) Date of Patent: Oct. 25, 2022

(54) CORDLESS HEIGHT-ADJUSTABLE INSTRUMENT TABLE

(71) Applicants: Kelly Burrows, Beach Park, IL (US); Brian Mangubat, Grayslake, IL (US); James Kim, Buffalo Grove, IL (US); Quinton Bankhead, Beach Park, IL (US)

(72) Inventors: Kelly Burrows, Beach Park, IL (US); Brian Mangubat, Grayslake, IL (US)

( * ) Notice: Subject to any disclaimer, the term of this patent is extended or adjusted under 35 U.S.C. 154(b) by 0 days.

(21) Appl. No.: 17/364,843

(22) Filed: Jun. 30, 2021

Related U.S. Application Data

(60) Provisional application No. 63/047,685, filed on Jul. 2, 2020.

(51) Int. Cl.
*A47B 21/06* (2006.01)
*A47B 1/04* (2006.01)
*A47B 9/20* (2006.01)

(52) U.S. Cl.
CPC ..... *A47B 21/06* (2013.01); *A47B 1/04* (2013.01); *A47B 9/20* (2013.01); *A47B 2021/066* (2013.01); *A47B 2200/0056* (2013.01); *A47B 2200/0062* (2013.01); *A47B 2200/0081* (2013.01)

(58) Field of Classification Search
CPC ..... A47B 9/20; A47B 1/04; A47B 2200/0056; A47B 2200/0062; A47B 2200/0081
See application file for complete search history.

(56) References Cited

U.S. PATENT DOCUMENTS

| | | | | |
|---|---|---|---|---|
| 10,524,564 | B1 * | 1/2020 | Wu | A47B 9/20 |
| 2011/0203496 | A1 * | 8/2011 | Garneau | A47B 9/20 248/404 |
| 2016/0008070 | A1 * | 1/2016 | Choudhury | A47B 9/20 108/106 |
| 2017/0164728 | A1 * | 6/2017 | Chang | A47B 1/08 |
| 2019/0365090 | A1 * | 12/2019 | Oakley | B60B 33/0078 |
| 2021/0368974 | A1 * | 12/2021 | Sudoh | A47B 9/16 |
| 2022/0053925 | A1 * | 2/2022 | Hung | A47B 23/00 |
| 2022/0087411 | A1 * | 3/2022 | Leslie | A47B 9/04 |
| 2022/0142357 | A1 * | 5/2022 | Grabowski | A47B 9/20 |

* cited by examiner

*Primary Examiner* — Daniel J Rohrhoff
(74) *Attorney, Agent, or Firm* — Fraline J. Allgaier

(57) ABSTRACT

A cordless height-adjustable instrument table is disclosed. The table includes a plurality of vertical support legs that are equally spaced at each side of a centralized height-adjustment column that is fixedly attached to the bottom portion of the table. The centralized height-adjustment column is fixedly placed above a four-wheel base that is coupled to a motor housing including a charging port, a rechargeable lithium battery pack, and electronic components being provided therein. The table further includes easy touch buttons for raising and lowering the table and a plurality of table extensions that increase the length and width. In practice, the user can actuate the easy touch buttons until a desired height of the table is obtained. A readily available 12-hour rechargeable lithium battery from retailers or manufactures is integrated for prolonged use of the table.

16 Claims, 8 Drawing Sheets

CORDLESS HEIGHT-ADJUSTABLE INSTRUMENT TABLE

RELATED APPLICATIONS

This application claims priority of U.S. Provisional Patent Application Ser. No. 63/047,685 filed Jul. 7, 2020.

TECHNICAL FIELD

This disclosure relates to cordless height-adjustable instrument tables. More specifically and without restriction to the particular embodiment and/or use which is shown and described for purposes of illustration, the present invention relates to a cordless height-adjustable instrument table with a rechargeable lithium battery pack.

BACKGROUND

Cordless devices including interchangeable or rechargeable battery packs are widely known in the prior art. It is also well known in the prior art to provide ergonomic tables or tables with segments that can be added or removed as desired by the user to change the overall size of a table. Common examples include dining or picnic tables being provided with extension segments and are supported by a plurality of adjustable leg portions. The overall size of such tables can be increased or decreased by adding or pulling apart the end segments or leg portions.

Tables incorporating height adjustable columns are also well known in the art. The height of most adjustable columns, as are known, can consist of inner, intermediate, and outer columns that are slidable into each other and extendable with respect to each other. The height-adjustment may be completed with a lifting mechanism being actuated manually or electrically. A drive element is an integral part of most advanced tables to effectuate a desired height.

Recently, certain advancements in the art have streamlined the determination of table height-adjustments. For example, U.S. Pat. No. 9,655,438 issued to Shoenfeld et al. describes an ergonomic workstation having upper and lower work platforms being disposed one above the other. Telescoping pedestals allowing precise adjustments of the desired elevation supports the platforms. The workstation features position sensors within each of the pedestals to sense the elevation of the upper end of the respective pedestal and provide an output to logic and motor control circuitry. This is configured to maintain the lower work platform level when the height of the lower work platform is being adjusted and to prevent the upper and lower work platforms from colliding, by maintaining at least a predetermined minimum vertical distance between the two work platforms when the lower work platform is being raised or when the upper work platform is being lowered.

US Patent Publication No. 2008/024529 filed by Chung Min Pan of Taiwan describes an automatic adjustable table that features a load board, at least one kingpost, and a controller. In use, the load board can rise and lower automatically, continuously, and periodically and thereby allowing the user to adjust his posture. U.S. Pat. No. 6,286,441 to Burdi et al. also discloses a motorized height adjustable table having a support base, a top assembly including a substantially horizontally disposed work surface, and first and second powered drive assemblies for raising and lowering the work surface. Among other features, the drive assemblies include motors that enable the vertical movement of the top assembly to adjust the height of the work surface. All of the aforementioned designs do not feature a cordless height-adjustable instrument table that allows the user to raise or lower a cordless height-adjustable instrument table with easy touch buttons. The work areas would also be limited to the work surfaces and workspaces as afforded by the embodiments prescribed.

U.S. Pat. No. 5,806,437 to Chun Te Huang discloses a table that has two legs, a base, two outer tabletop segments, and two folding tabletop segments. The table features outer tabletop segments that are mounted on the base and are slidable, foldable, and flippable into desired position through an organized structure of racks and gears. The shortening of this tabletop design would require the folding or flipping of the segments underneath the table. Therefore, the table remains in a shortened configuration and cannot be extended beyond the slidable, foldable, or flappable portions that are provided.

Cordless tools including interchangeable battery units are widely known in the prior art, as exemplified for example by U.S. Pat. Nos. 3,043,996; 3,381,636; 3,533,119; 3,186,878, and 3,757,194. However, the overall idea of the products described in these patents has been to substitute a packaged battery-type source of energy as an alternative to the conventional line cord set provided with corded power tools. Therefore, these patents describe already established tools with the mere addition of receptacles that are adapted to receive a battery.

It is believed, however, that none of the above disclosures describe the cordless adjustment of a cordless height-adjustable instrument table using easy touch buttons. Developing a cordless height-adjustable instrument table that allows the user to raise or lower it to suit his or her particular needs is thus an unmet need in the art. To overcome the shortcomings, the present invention provides a cordless adjustable table to mitigate or obviate the aforementioned problems. Therefore, it is an object of the present invention to create a cordless height-adjustable instrument table having at least two vertical support legs being equally spaced at each side of a centralized height-adjustment column that is fixedly attached to the underside surface of said table. The centralized height-adjustment column is fixedly placed above a four-wheel base that is coupled to a motor housing including a charging port, a battery pack, and electronic components being provided therein. The cordless height-adjustable instrument table being lowered and raised by easy touch buttons that are mounted thereon. The cordless height-adjustable instrument table is extendable as desired with a plurality of extensions that increase the length and width.

To this end, the invention relates to a cordless height-adjustable instrument table having a tabletop defining a substantially planar instrument work surface having a top surface, a length, a width, peripheral edges being attached to c-tracks, a bottom portion, a centralized height-adjustment column for adjusting the elevation thereof, a plurality of vertical support legs, and a plurality of table extensions. The novel and distinctive features of the invention consist of a plurality of cordless height-adjustable instrument table support elements that are provided on the exterior or interior of the surface of the table. The instrument is further characterized with the following novel features: (1) A centralized height-adjustment column that is fixedly placed above a four-wheel base and in which a motor housing and a motor are coupled thereon; (2) The centralized height-adjustment column having a lockable extended position whereby the relative upward and downward movements of the tabletop are directed by sectional columns that are engaged and disengaged by a motor; (3) The motor housing including a motor, a charging port, a rechargeable lithium battery pack, and electronic components being provided therein, and wherein the motor changes the elevation of the tabletop using battery power and a manually operable control panel; (4) A plurality of vertical support legs providing telescoping support for the tabletop once the cordless height-adjustable instrument table is raised or lowered; (5) A plurality of table extensions having inner channels molded into the undersides thereof and outer lips extending therefrom for telescopic connection to the tabletop and thereby allowing for the extension of the tabletop as desired by a user.

SUMMARY OF THE INVENTION

In order to accomplish the objects of the present invention, there is provided a cordless height-adjustable cordless height-adjustable instrument table. The cordless height-adjustable instrument table having a plurality of support legs being provided at opposite ends and wherein said vertical support legs are equally spaced at each side of a centralized height-adjustment column.

Another advantage of the present invention is to provide a cordless height-adjustable instrument table with a centralized height-adjustment column that is fixedly placed above a four-wheel base that is generally rectangular and in which a motor housing is coupled between the column and the four-wheel base.

Another advantage of the present invention is to provide a cordless height-adjustable instrument table wherein the motor housing includes a charging port, a rechargeable lithium battery pack, and electronic components being provided therein.

Another advantage of the present invention is to provide a cordless height-adjustable instrument table wherein a 12-hour rechargeable lithium battery pack is integrated for prolonged use.

Another advantage of the present invention is to provide a cordless height-adjustable instrument table wherein the cordless height-adjustable instrument table has an operational control panel having easy touch buttons being mounted on its underside and wherein it can be lowered with said touch buttons having first and second controls for raising and lowering the same.

Still another advantage of the present invention is to provide a cordless height-adjustable instrument table wherein the cordless height-adjustable instrument table is provided with a plurality of spaced apart mounting mechanisms to facilitate the manual insertion and support of extensions that increase the length and width of the same.

Still another objective of the present invention is to provide a cordless height-adjustable instrument table wherein the extensions include extension sections creating a substantially L-shaped cordless height-adjustable instrument table once said extension section is mounted on the same.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

BRIEF DESCRIPTION OF THE SEVERAL VIEWS OF THE DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

The following detailed description is the best-contemplated mode of carrying out the invention. Although the invention has been explained in relation to its preferred embodiment, it is to be understood that many other possible modifications and variations can be made without departing from the spirit and scope of the invention.

Figure 1:
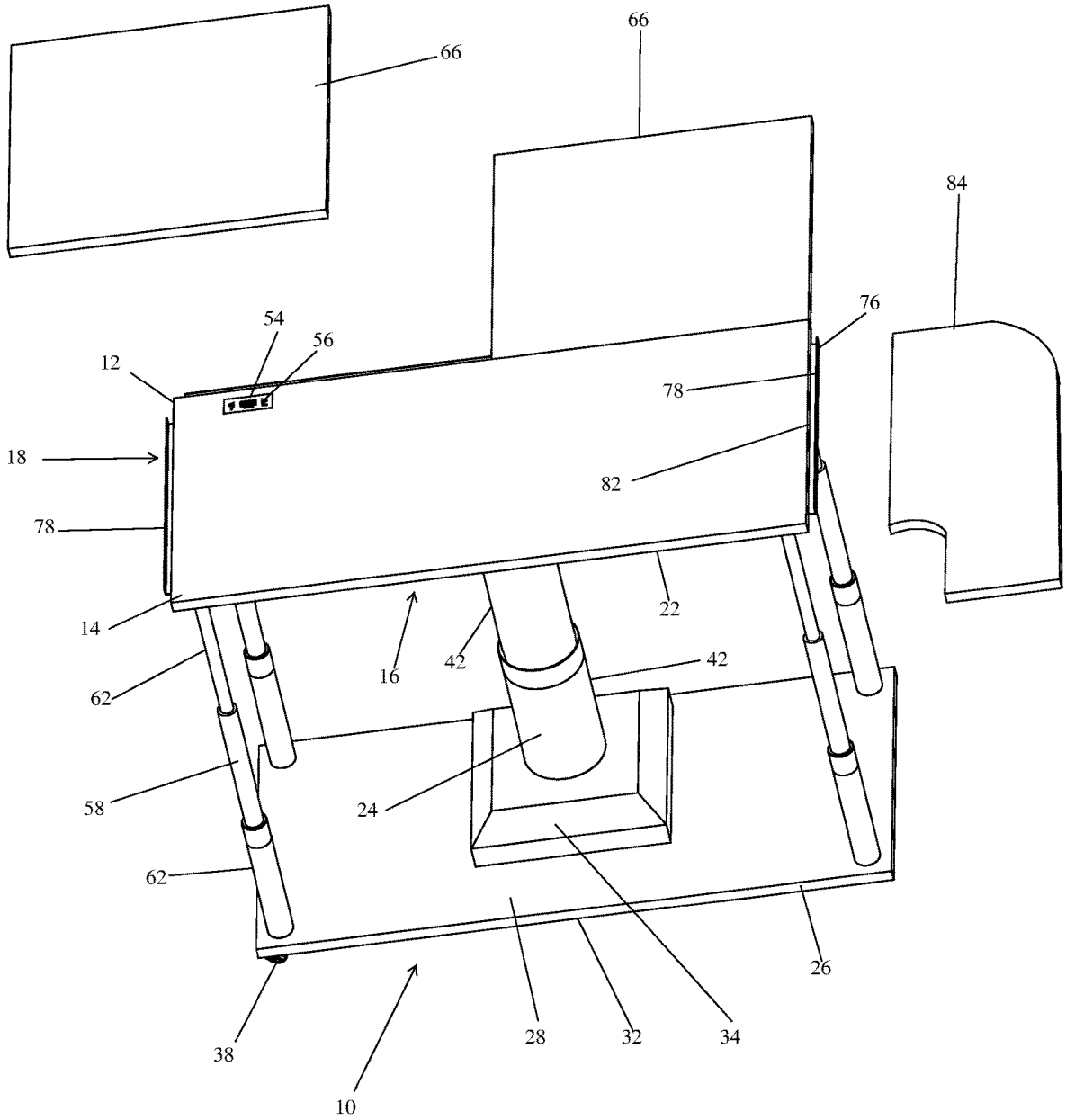
FIGS. 1-5 show a cordless height-adjustable instrument according to one embodiment.
Figure 2:
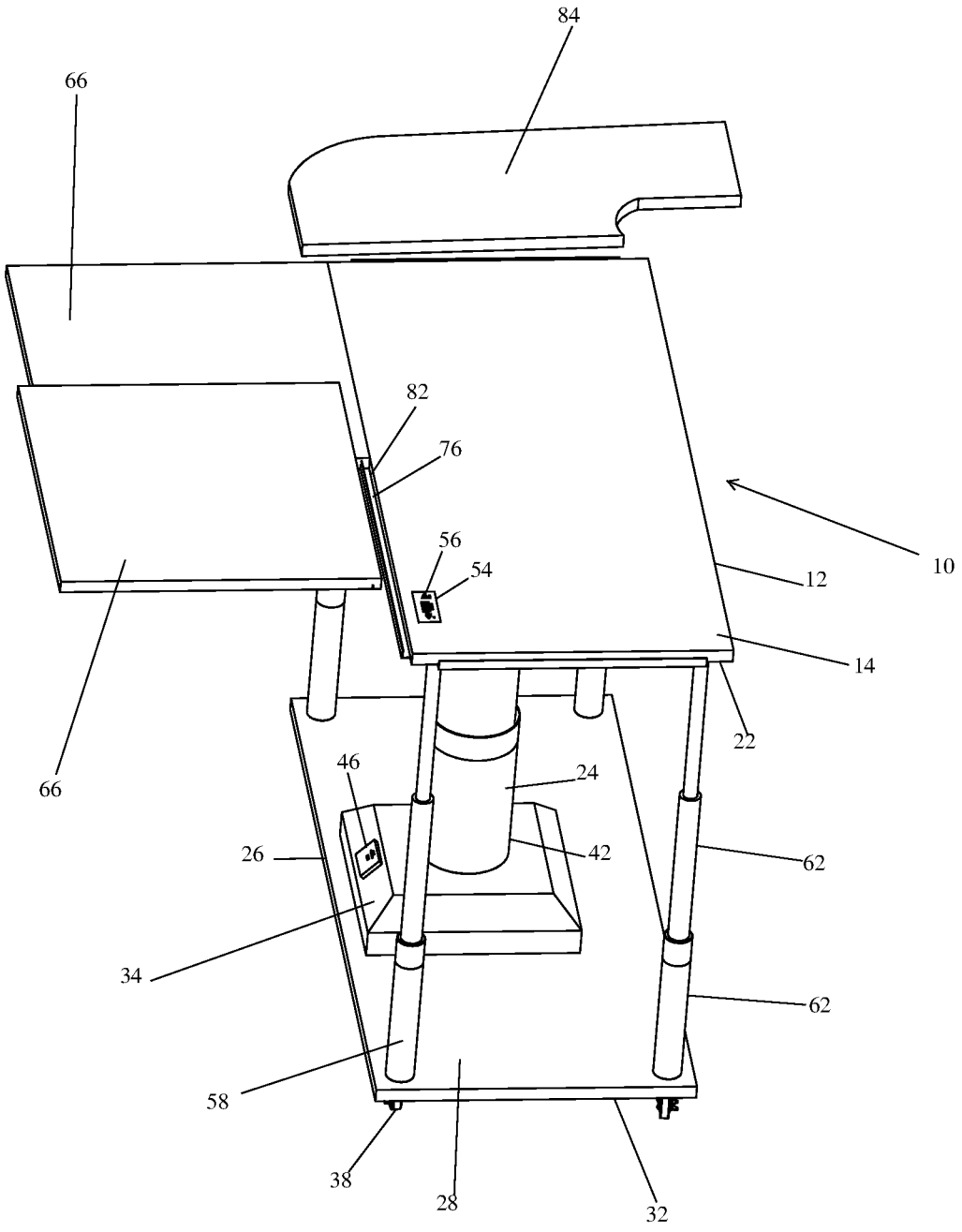
Figure 3:
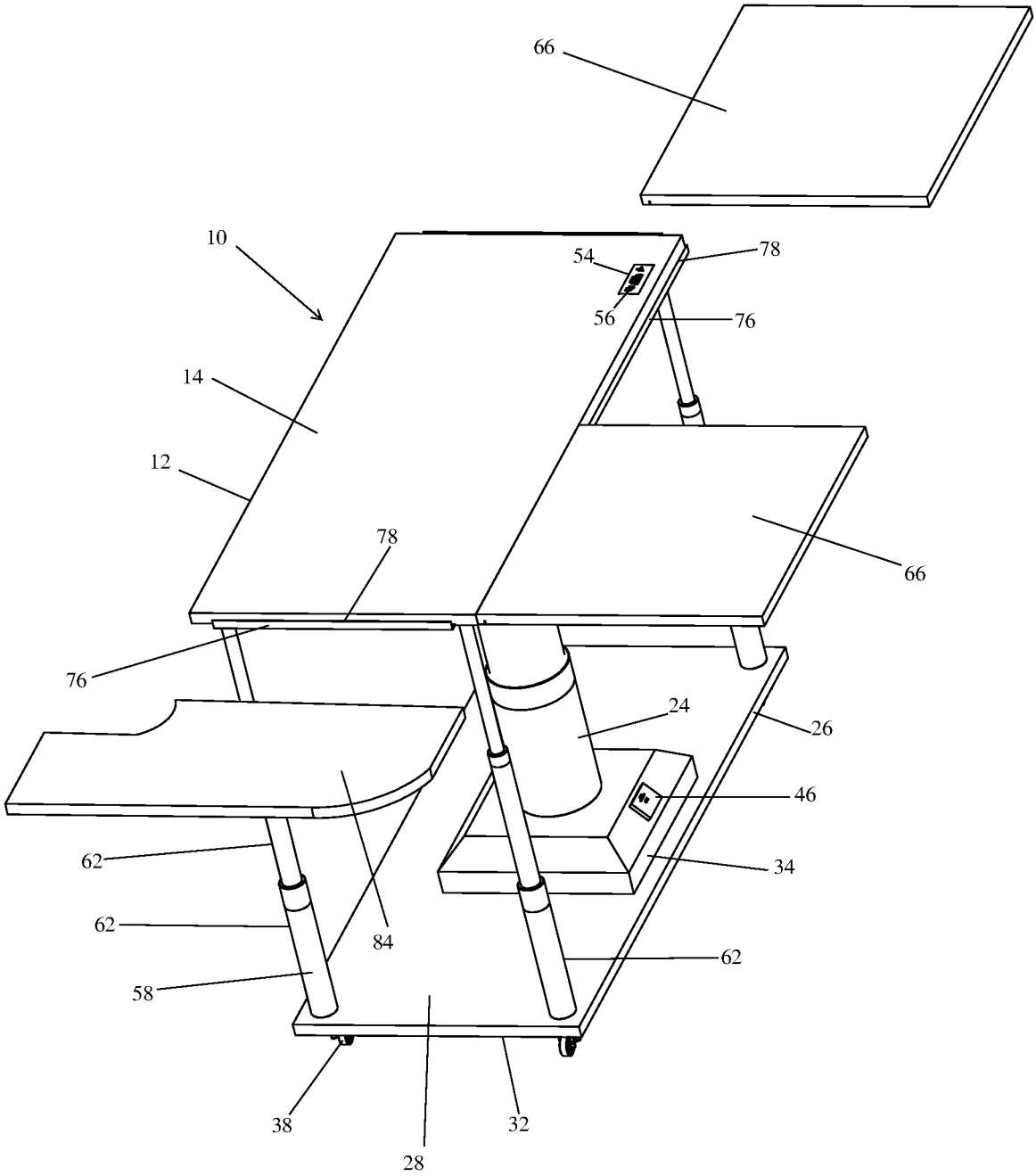
Figure 4:
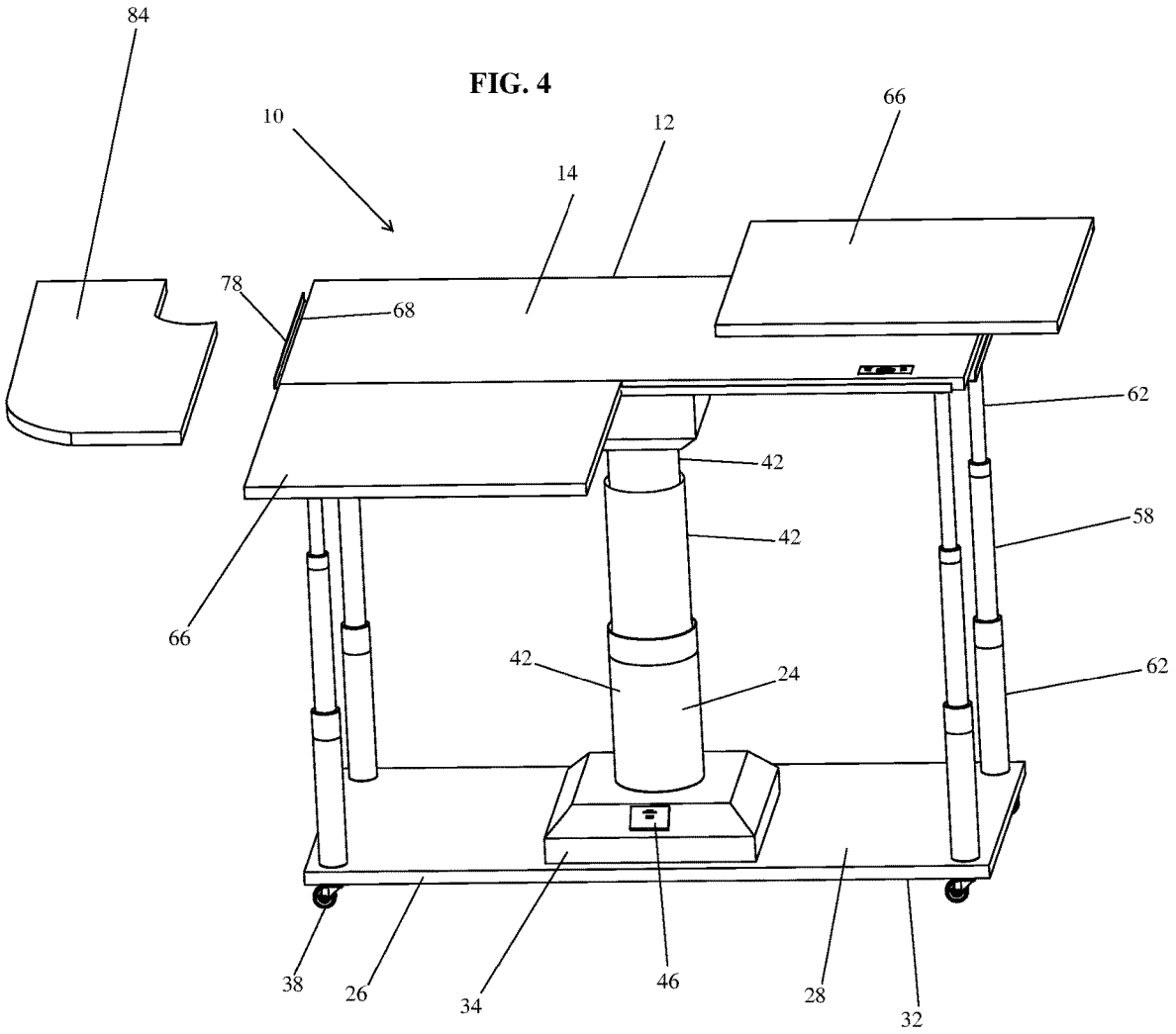
Figure 5:
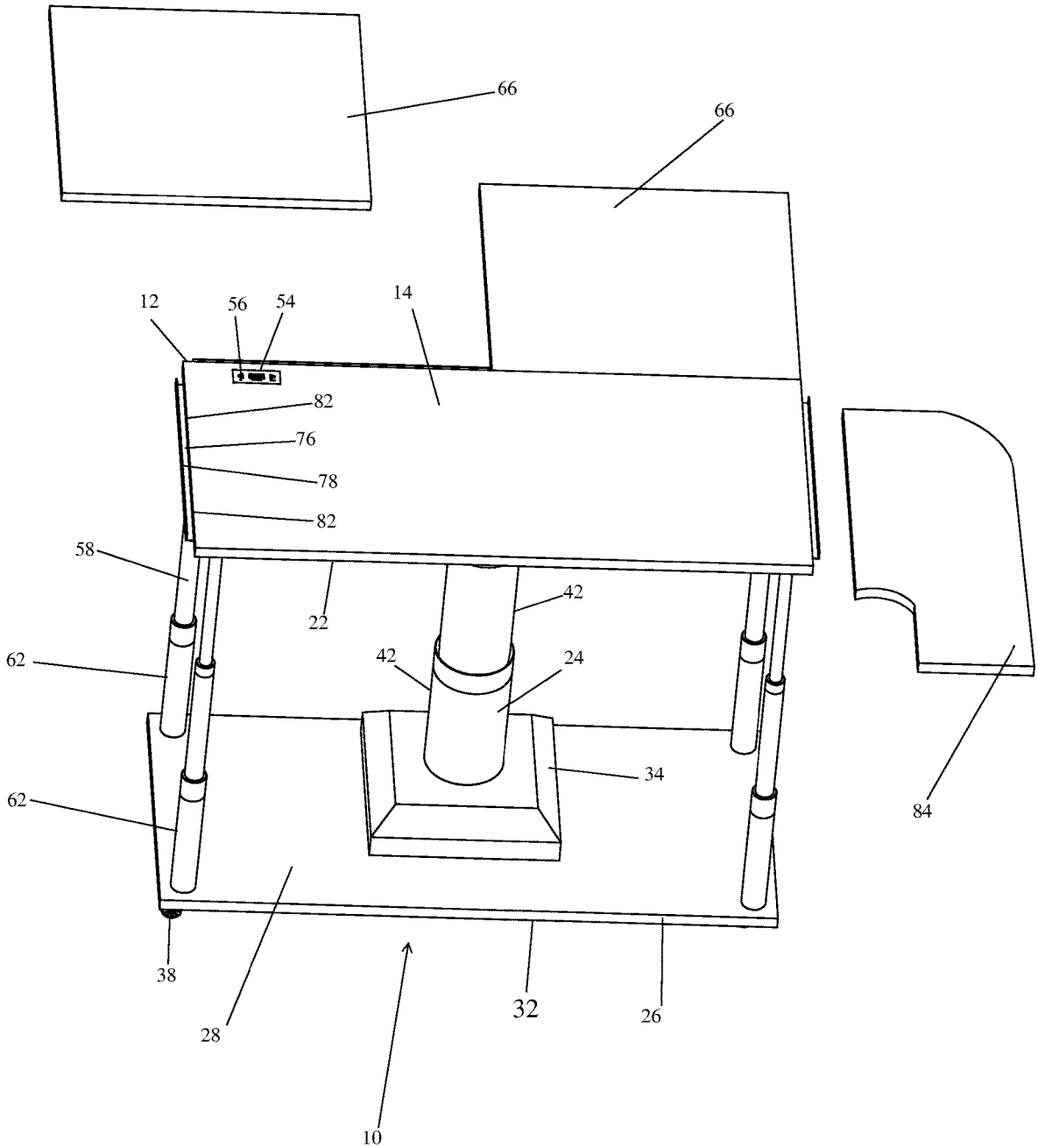
Figure 6:
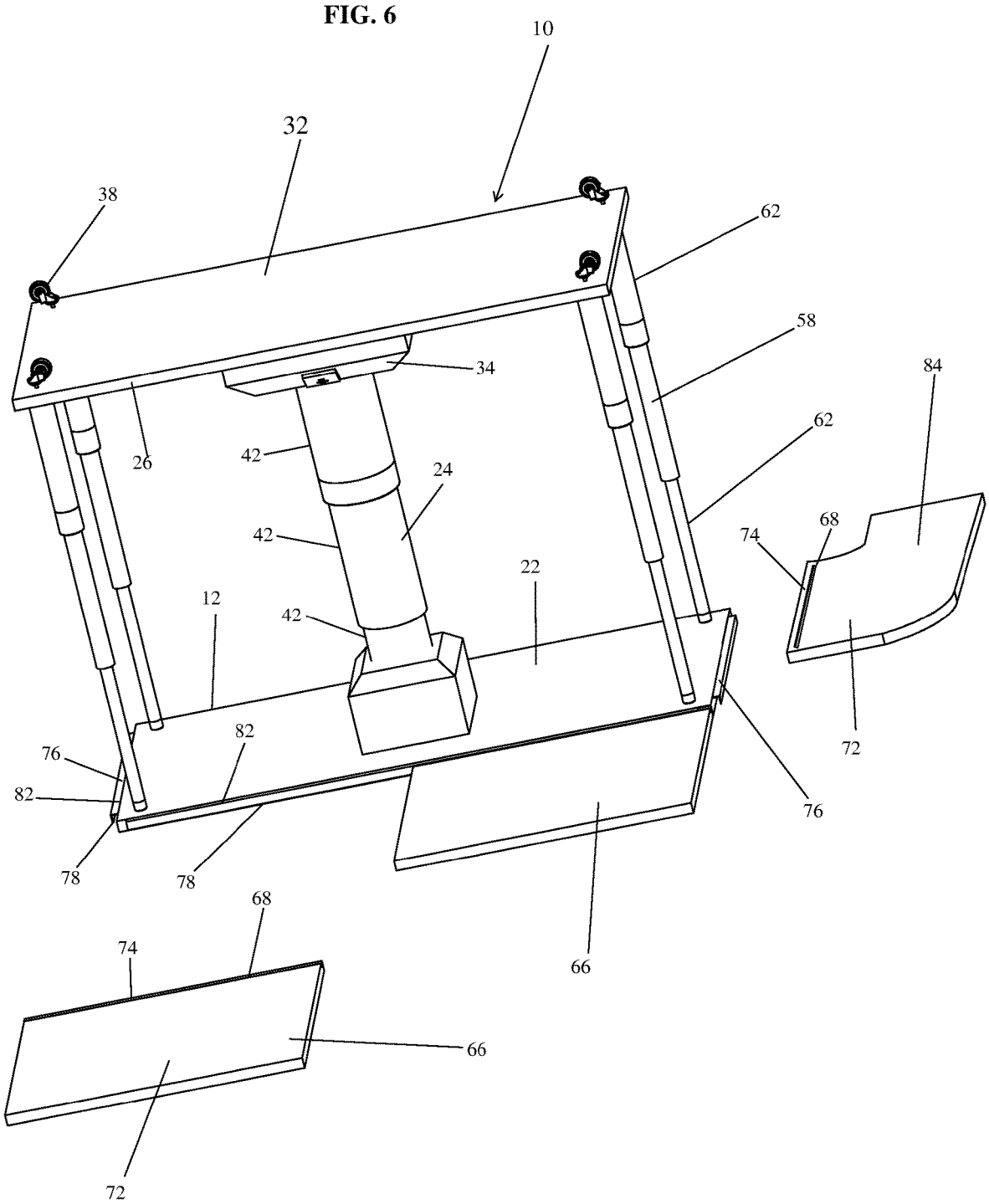
FIG. 6 is a bottom view a cordless height-adjustable instrument according to one embodiment.
Figure 7:
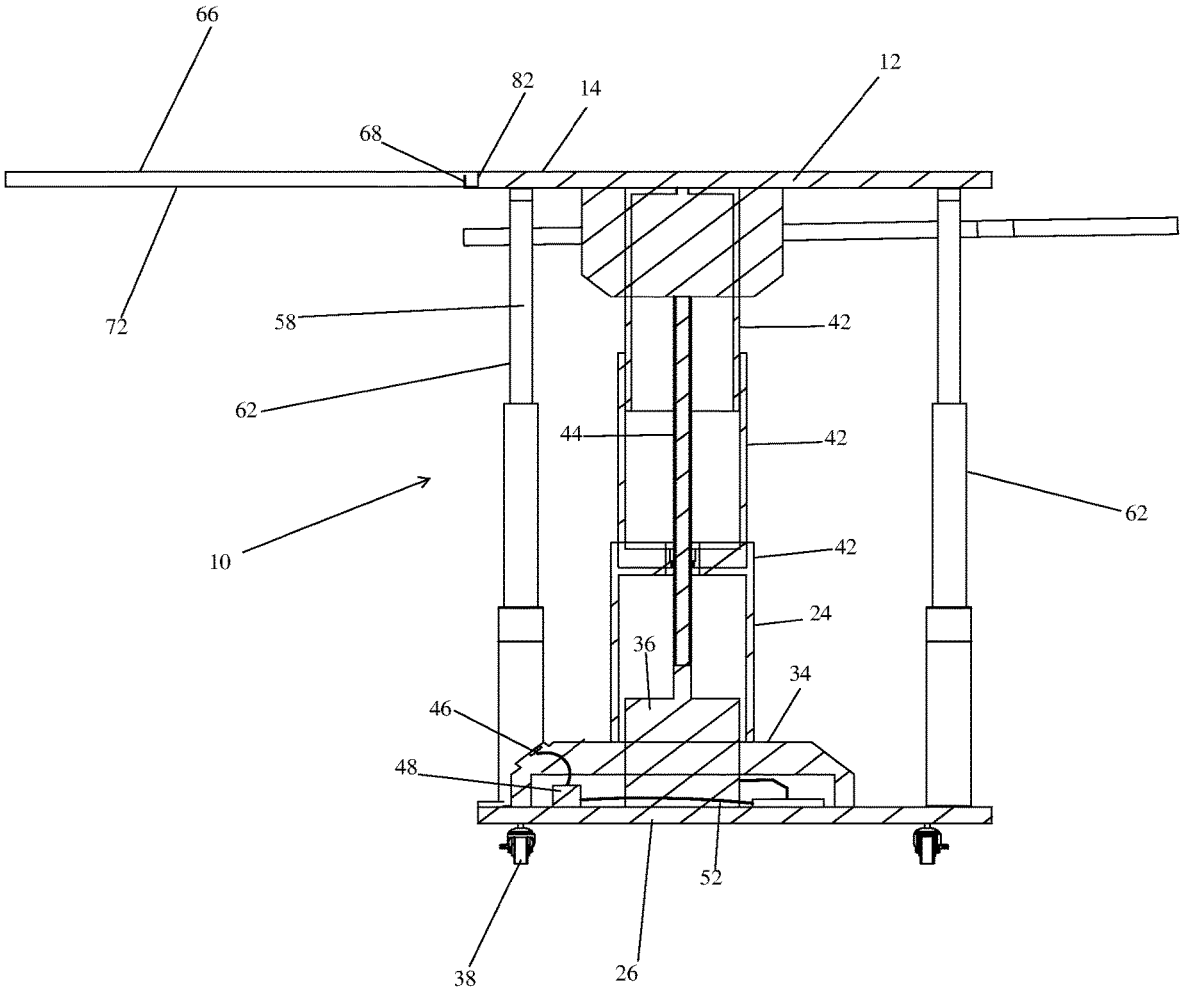
FIG. 7 shows a cross sectional view of the centralized column according to one embodiment and showing the motor housing, charging port, rechargeable lithium battery pack, and electronic components being provided therein.
Figure 8:
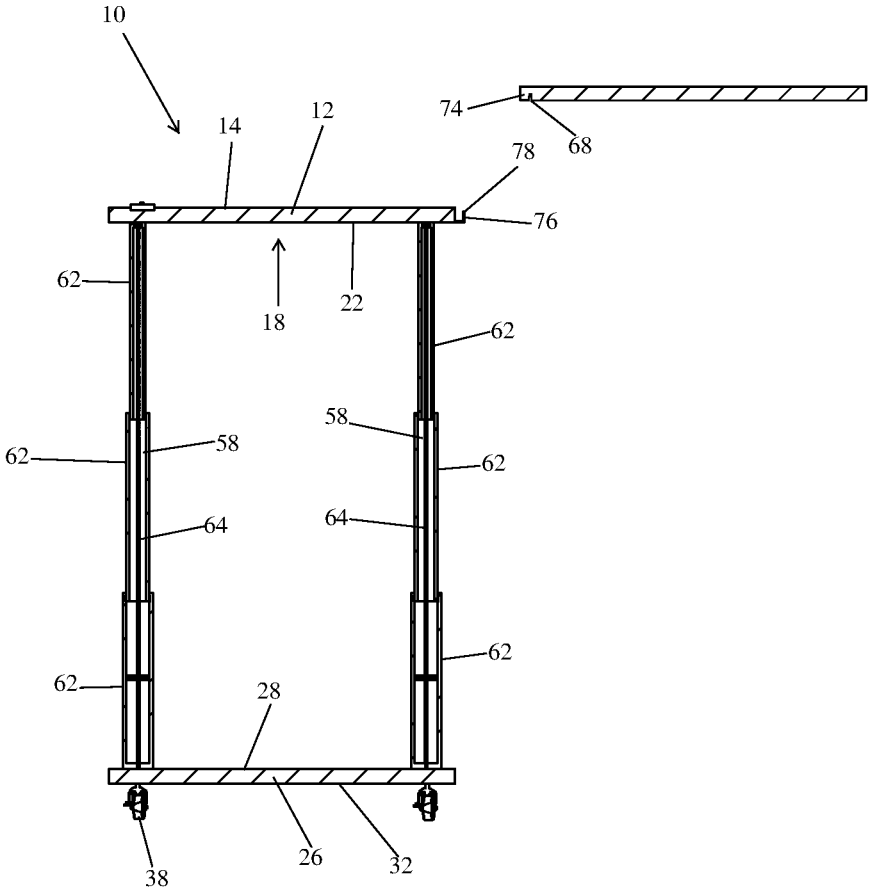
FIG. 8 shows a cross sectional view of a vertical support leg according to one embodiment of the present invention.

FIGS. 1-6 show a cordless height-adjustable instrument table 10 according to one embodiment of the invention as prescribed herein. In this embodiment, the cordless height-adjustable instrument table 10 features a tabletop 12 defining a substantially planar instrument work surface having a top surface 14, a length 16, a width 18, peripheral edges 82 being attached to c-tracks 76, a bottom portion 22, a centralized height-adjustment column 24 for adjusting the elevation thereof, a plurality of vertical support legs 58, and a plurality of table extensions 66.

The centralized height-adjustment column 24 is fixedly placed above a four-wheel base 26 having top 28 and bottom sides 32 and wherein the centralized height-adjustment column 24 is generally cylindrical in shape and in which a motor housing 34 and a motor 36 are coupled between the centralized height-adjustment column 24 and the four-wheel base 26. The four-wheel base 26 defining a bottom section of the cordless height-adjustable instrument table 10 and include a plurality of non-retractable wheels 38 attached to its bottom side 32. The centralized height-adjustment column 24 is placed in a lockable extended position whereby the relative upward and downward movements of the tabletop 12 are directed by the sectional columns 42 of the centralized height-adjustment column 24 that are engaged and disengaged by the motor 36 and the rotation of a threaded rod 44 that is attached thereon.

The motor housing 34 includes the motor 36, a charging port 46, a rechargeable lithium battery pack 48, and electronic components 52. The motor 36 directs the elevation of the tabletop 12 using battery power and a manually operable control panel 54 that is in operational communication with the motor 36. The control panel 54 includes easy touch buttons 56 having first and second controls for raising and lowering said cordless height-adjustable instrument table 10 as desired by a user. It is secured to the top surface 14 of said tabletop 12 and is operable therefrom. The buttons can be constructed in a manner to smoothly raise and lower the height of the tabletop through the central column 24. The user could control the raising and lowering of the tabletop 12 via the up/down buttons located on the control panel 54 located at the left of the tabletop 12. They can be secured by means of bolts to the underside of the tabletop or with an improved switch mechanism for controlling the raising and lowering of the table. This would ensure that the table is moved in a uniform manner.

The plurality of vertical support legs 58 having threaded rods 64 provided therein for directing the rotation of cylindrical members 62 for telescoping support of the tabletop 12 once the cordless height-adjustable instrument table 10 is raised or lowered. The plurality of vertical support legs 58 is coupled to the bottom portion 22 of the tabletop 12 and to the four-wheel base 26 and wherein said plurality of vertical support legs 58 is adapted for movement of said tabletop 12 between a raised and a lowered position. The threaded rods 64 of the plurality of vertical support legs 58 are provided in lockable extended positions whereby the relative upward and downward movements of the tabletop 12 are prevented once the motor 36 is engaged. The centralized height-adjustment column 24 is therefore a supporting mechanism that elevates the tabletop 12 relative to the vertical support legs 58 and wherein the motor 36 is provided for holding the tabletop 12 in raised or lowered positions. The hand-operated control panel 54 selectively engages the threaded rod 64 thereof in the direction that is desired by the user.

The plurality of table extensions 66 feature inner channels 68 molded into the undersides 72 and outer lips 74 extending therefrom. The rectangular shaped c-tracks 76 of the tabletop 12 include top rails 78 that are interconnected with the peripheral edges 82 of the tabletop 12 and thereby allowing the inner channels 68 of the plurality of table extensions 66 to be telescopically received therein. The top rails 78 of the c-tracks 76 are slightly smaller than the inner channels 68 of the plurality of table extensions 66 allowing the inner channels 68 of the plurality of table extensions 66 to telescopically receive the c-tracks 76 and thereby allowing for the extension of the tabletop 12. The plurality of table extensions 66 thereby facilitates the increase in the length 16 or width 18 of the cordless height-adjustable instrument table 10.

For example, and without limitation, FIGS. 1-6 show the cordless height-adjustable instrument table 10 having the plurality of vertical support legs 58 being fixedly attached to the bottom portion 22 of the tabletop 12. It should be understood that the plurality of vertical support legs 58 and embodiments shown and described in the figures and throughout this specification are exemplary and non-limiting. More or fewer vertical support legs 58 and embodiments can be placed on the cordless height-adjustable instrument table 10 to obtain as much structural and functional support as prescribed by the user. For example, the vertical support legs 58 can be fitted with the proper reinforcements and can be constructed in a manner to stabilize the tabletop 12 while it is in use and to ensure that the tabletop 12 is kept in a horizontal position. They can be securely connected in a freely extendable or contractable manner on the base 26 that is fixed below the table. They can be further constructed in a manner to allow the table surface to be permanently locked in a specified position. For example, the vertical support legs 58 can be adapted for placement in open or closed positions and for selective extension of the upper portions or the lower portions of the leg away from the base 26.

In this embodiment, the centralized height-adjustment column 24 is fixedly placed above a four-wheel base 26 that is generally rectangular and in which a motor housing 34 is coupled between the column 24 and the four-wheel base 26. The column 24 can function like a central hub and should be constructed to be sufficiently large and provide sufficient table elevation.

Exemplary table extensions 66 are shown according to a plurality of embodiments. It should be understood that these table extensions 66 are for illustrative purposes only. The table extensions 66 can include additional components, designs, and shapes as desired. The extensions 66 increase the length 16 and width 18 of the table and can be produced with at least one substantially L-shaped table extension 84 creating a substantially L-shaped cordless height-adjustable instrument table 10 once the L-shaped table extension section 84 is mounted on the tabletop 12. At least two separate table extensions would be necessary to accommodate situations when more surface area is necessary for operating instruments that are larger or longer in length 16. Accessory table extension surfaces in limitless, different shapes would be offered, affixed to the main table surface through a mechanical bracket and/or hardware attachment configuration to be utilized with mechanisms located at each end of the tabletop 12 for affixing the extension 66 surfaces.

The tabletop 12 would be rectangular in shape. The unit could be produced primarily of instrument stainless steel, being a grade of stainless steel used in biomedical applications. These steel material compositions could include austenitic SAE 316 stainless, martensitic SAE 440, SAE 420, or 17-4 stainless steel, and could include a thin layer of chromium oxide as a rust and corrosion preventative. The overall size, all parts and componentry sizes, shapes, configuration, material composition, dimensions, and user interface applications would be developed during the design and engineering phases, prior to manufacture. The unit would also contain electronic components 52 housed with the tabletop 12 and column 24, as well as the motor 36 and battery pack 48 located in the bottom of the column 24. All electronics could be housed within plastic modules and protected with silicone, rubber, or synthetic Neoprene gaskets for waterproofing.

Function and Appealing Features

The table is being suggested by the inventors because they believe it would fulfill the need for a modified, electronically height adjustable operating room/cordless height-adjustable instrument table with extension capabilities. The appealing features of the table would be its ease of use, sterile surface material, convenience, functionality, safety, and efficiency provided for the hospital, clinic, or veterinarian staff. Due to its ability to be adjusted in height, as well as in extended widths and shapes, the tabletop surface 14 could provide unlimited surface area for an array of instruments and tools. It would provide ergonomic table surface height and configuration to assist in operating procedures without the need for staff to bend over or extend themselves upward in awkward angles. The unit would also provide functioning without the need for electrical cords, which could normally interfere with operating procedures. The easy touch buttons 56 would enable the smooth and quiet table operation. The invention would also be set on four wheels 38 for easy maneuverability around instrument areas. The table would be useful to all professional hospital and clinic instrument staff, as well as veterinarians. It could even be useful for culinary preparations.

Variations

The potential exists for varying the production of the table in ways, which could make it more appealing to a wider range of end users. This could include producing the unit with various extension table surfaces that could increase the length 16 or width 18 of the original table size, as well as in a L-shaped configuration.

Production

It appears that the table could be produced easily using conventional and readily available materials and manufacturing processes. No new production technology would be required. The table could be produced in an instrument stainless steel, typically used in biomedical applications. The stainless steel material compositions could include austenitic SAE 316 stainless, martensitic SAE 440, SAE 420, or 17-4 stainless steel, and could include a thin layer of chromium oxide as a rust and corrosion preventative. All stainless steel parts could be made through CNC computerized processes such as laser cutting, water jet cutting, CNC routing, robotic machining, or extrusion for part consistency, with secondary production methods included such as stamping, deburring, drilling, filing, and sanding. Any plastic components could be produced through the injection-molding process in a variety of hard plastics including a thermoplastic polymer such as ABS, a recycled composite material, or a high-density polyethylene (HDPE). Colors would be included in this primary manufacturing molding procedure. Any silicone, rubber, or synthetic Neoprene gaskets could also be injection-molded. The motor 36, battery pack 48, control panels 54, wheels 38, and all required hardware could be made of standard items. Of course, other materials and manufacturing processes could also be considered for this product.

Packaging

In the event that the table is manufactured, it will require a package. Developing a package for a new product involves numerous considerations. Requirements for packaging can be highly variable. Some items, such as automobiles and heavy machinery, are not usually packaged. Other items, notably consumer goods, require elaborate packaging designs. Industrial packaging is primarily concerned with identifying and protecting the product during shipment and storage. While some industrial products can be shipped as single units, others must be shipped as sub-assemblies and used in the production process or installed by millwrights or technicians at plant facilities. The table could be packaged in a corrugated cardboard box. The package could have a label printed in one or more colors (including four-color process) on a pressure-sensitive paper stock. The label could give the product name, manufacturer, and instructions for use. A small pamphlet could be included in each package detailing instructions for use and care. Corrugated cardboard shipping containers would then be used to hold a quantity of individually packaged products to facilitate shipment and storage.

A number of illustrative embodiments have been described. Nevertheless, it will be understood that various modifications may be made without departing from the spirit and scope of the various embodiments presented herein. Accordingly, other embodiments are within the scope of the following claims.

What is claimed is:

1. A cordless height-adjustable instrument table comprising:

a) a tabletop defining a substantially planar instrument work surface having a top surface, a length, a width, peripheral edges being attached to c-tracks, a bottom portion, a centralized height-adjustment column for adjusting the elevation thereof, a plurality of vertical support legs, and a plurality of table extensions;

b) wherein said centralized height-adjustment column is fixedly placed above a four-wheel base having top and bottom sides, said centralized height-adjustment column being generally cylindrical in shape and in which a motor housing and a motor are coupled between said centralized height-adjustment column and said four-wheel base, said four-wheel base defining a bottom section of said cordless height-adjustable instrument table and having said four-wheel base attached to the bottom side thereof; said centralized height-adjustment column having a lockable extended position whereby the relative upward and downward movements of said tabletop are directed by the sectional columns of said centralized height-adjustment column that are engaged and disengaged by said motor and the rotation of a threaded rod that is attached thereon;

c) wherein said motor housing includes said motor, a charging port, a rechargeable lithium battery pack, and electronic components being provided therein, said motor changing the elevation of said tabletop using battery power and a manually operable control panel that is in operational communication with said motor and wherein said control panel includes easy touch buttons having first and second controls for raising and lowering said cordless height-adjustable instrument table;

d) said plurality of vertical support legs having threaded rods provided therein for directing the rotation of cylindrical members for telescoping support of said tabletop once said cordless height-adjustable instrument table is raised or lowered, said plurality of vertical support legs being coupled to the bottom portion of said tabletop and to said four-wheel base, wherein said plurality of vertical support legs are adapted for movement of said tabletop between a raised and a lowered position; said threaded rods of said plurality of vertical support legs being provided in lockable extended positions whereby the relative upward and downward movements of said tabletop are prevented once said motor is engaged;

e) said plurality of table extensions having inner channels molded into the underside thereof and outer lips extending therefrom, f) said c-track having top rails and being rectangular in shape and being interconnected with said peripheral edges of said tabletop and allowing said inner channels of said plurality of table extensions to be telescopically received therein, with the top rails of said c-tracks being slightly smaller than the inner channels of said plurality of table extensions allowing said inner channels of said plurality of table extension to telescopically receive said c-tracks and thereby allowing for the extension of said tabletop.

2. The cordless height-adjustable instrument table according to claim 1 wherein the control panel of said cordless height-adjustable instrument is secured to the top surface of said tabletop and is operable therefrom.

3. The cordless height-adjustable instrument table according to claim 1 wherein the cordless height-adjustable instrument table is configured to receive said plurality of table extensions.

4. The centralized height-adjustment column of claim 1 wherein said centralized height-adjustment column is a supporting mechanism that elevates said tabletop relative to the vertical support legs.

5. The motor according to claim 1 wherein said motor is provided for holding said tabletop in raised or lowered positions.

6. The control panel according to claim 1 wherein said control panel is a hand-operated control device selectively engaging the threaded rod in a first direction and in a second direction.

7. The cordless height-adjustable instrument table according to claim 1 wherein said plurality of table extensions of said cordless height-adjustable instrument increase said length of said cordless height-adjustable instrument table.

8. The cordless height-adjustable instrument table according to claim 1 wherein said plurality of table extensions of said cordless height-adjustable instrument increase said width of said cordless height-adjustable instrument table.

9. A cordless height-adjustable instrument table comprising:

a) a tabletop defining a substantially planar work surface having a length, a width, peripheral edges being attached to c-tracks, a bottom portion, a centralized height-adjustment column for adjusting the elevation thereof, b) a plurality of vertical support legs having threaded rods provided therein for directing the rotation of cylindrical members for telescoping support of said tabletop once said cordless height-adjustable instrument table is raised or lowered, said plurality of vertical support legs being coupled to the bottom portion of said tabletop and to a four-wheel base, wherein said plurality of vertical support legs are adapted for movement of said tabletop between a raised and a lowered position; said threaded rods of said plurality of vertical support legs being provided in lockable extended positions whereby the relative upward and downward movements of said tabletop are prevented once said motor is engaged;

c) wherein said motor housing includes said motor, a charging port, a rechargeable lithium battery pack, and electronic components being provided therein, said motor changing the elevation of said tabletop using battery power and a manually operable control panel that is in operational communication with said motor and wherein said control panel includes easy touch buttons having first and second controls for raising and lowering said cordless height-adjustable instrument table;

d) a plurality of vertical support legs having inner and outer cylindrical members for telescoping support of said tabletop, said plurality of vertical support legs being coupled to the bottom portion of said tabletop and to said four-wheel base, wherein said plurality of vertical support legs are adapted for movement of said tabletop between a raised and a lowered position; said plurality of vertical support legs having lockable extended positions whereby the relative upward and downward movements of said tabletop are prevented;

e) a plurality of table extensions having inner channels molded into the underside thereof and outer lips extending therefrom, f) the c-track having top rails and being rectangular in shape and being interconnected with said peripheral edges of said tabletop and allowing said inner channels of said plurality of table extensions to be telescopically received therein, with said top rails of said c-tracks being slightly smaller than the inner channels of said plurality of table extensions allowing said inner channels of said plurality of table extensions to telescopically receive said c-tracks and thereby allowing for the extension of said tabletop;

g) wherein said cordless height-adjustable instrument table includes at least one substantially L-shaped table extension wherein said tabletop assumes an L-shape once said at least one substantially L-shaped table extension is mounted thereon.

10. The cordless height-adjustable instrument table according to claim 9 wherein the control panel of said cordless height-adjustable instrument is secured to said top surface of said tabletop and is operable therefrom.

11. The cordless height-adjustable instrument table according to claim 9 wherein said cordless height-adjustable instrument table is configured to receive said plurality of table extensions.

12. The centralized height-adjustment column of claim 9 wherein said centralized height-adjustment column is a supporting mechanism that elevates said tabletop relative to said plurality of vertical support legs.

13. The motor according to claim 9 wherein said motor is provided for holding said tabletop in raised or lowered positions.

14. The control panel according to claim 9 wherein said control panel is a hand-operated control device selectively engaging the threaded rod in a first direction and in a second direction.

15. The cordless height-adjustable instrument table according to claim 9 wherein said plurality of table extensions of said cordless height-adjustable instrument increases the length of said cordless height-adjustable instrument table.

16. The cordless height-adjustable instrument table according to claim 9 wherein said plurality of table extensions of said cordless height-adjustable instrument increases the width of said cordless height-adjustable instrument table.

* * * * *